US006016629A

United States Patent [19]

Sylvester et al.

[11] Patent Number: 6,016,629

[45] **Date of Patent: *Jan. 25, 2000**

[54] WALK-THROUGH GATE

[75] Inventors: Scott Allen Sylvester, Sobieski, Wis.; Clifford W. Russell, Denver, Colo.

[73] Assignee: Evenflo Company, Inc., Vandalia, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,972

[22] Filed: Oct. 25, 1996

[51] Int. Cl.[7] ..... E06B 3/68

[52] U.S. Cl. ..... 49/55; 49/394

[58] Field of Search ..... 49/55, 50, 394, 49/463, 465, 57, 399; 16/368, DIG. 43, 271

[56] References Cited

U.S. PATENT DOCUMENTS

| | | | |
|---|---|---|---|
| D. 341,207 | 11/1993 | Freese et al. | D25/38 |
| 1,438,202 | 12/1922 | Wieland . | |
| 1,519,908 | 12/1924 | Etue . | |
| 2,851,746 | 9/1958 | McPhaden | 20/71 |
| 3,346,289 | 10/1967 | Anderson | 292/175 |
| 3,636,683 | 1/1972 | Francis et al. | 55/493 |
| 3,800,714 | 4/1974 | Stark et al. | 105/377 |
| 4,139,249 | 2/1979 | Hillman | 312/333 |
| 4,377,303 | 3/1983 | McPherson | 292/152 |
| 4,482,023 | 11/1984 | Dziedzic | 180/89.17 |
| 4,607,455 | 8/1986 | Bluem et al. | 49/55 |
| 4,677,791 | 7/1987 | Larson et al. | 49/463 |
| 4,884,614 | 12/1989 | Spurling | 160/225 |
| 5,018,302 | 5/1991 | Kluge | 49/56 |
| 5,134,806 | 8/1992 | Burkart | 49/463 |
| 5,217,265 | 6/1993 | Lerner et al. | 292/200 |
| 5,272,840 | 12/1993 | Knoedler et al. | 49/463 |
| 5,367,829 | 11/1994 | Crossley et al. | 49/465 |
| 5,437,115 | 8/1995 | Freese et al. | 49/465 |
| 5,442,881 | 8/1995 | Asbach et al. | 49/465 |
| 5,524,994 | 6/1996 | Berg | 292/163 |
| 5,531,258 | 7/1996 | Poulson et al. | 160/376 |

*Primary Examiner*—Jerry Redman
*Attorney, Agent, or Firm*—Robert G. Crouch; Holland & Hart LLP

[57] ABSTRACT

A pivotably-mounted extendable gate for restricting access by infants or pets through an opening defined by a pair of opposed vertical surfaces or walls. The gate is pivotably mounted via hinges pivotably attached to the gate which are slidably received within sleeves of retaining brackets mounted to one of the walls. The gate is extendable and retractable via two separate and similar gate members which are slidably coupled together. A pair of vertically-spaced-apart receptacles mounted on the opposite walls receive upper and lower portions of one of the gate members to prevent pivotable movement of the gate when so received. A latch provided on the upper portion of the gate engages with the upper receptacle to prevent sliding movement of the gate.

24 Claims, 5 Drawing Sheets

WALK-THROUGH GATE

The present invention relates to an improved design for a walk-through gate and, more particularly, to a walk-through gate which can be sturdily and removably attached to opposed vertical surfaces, as well as being pivotably attached to one of the opposed surfaces.

BACKGROUND OF THE INVENTION

It is well-known to provide safety gates for doorways or staircases to prevent the passage therethrough of small children, infants, or pets. One common design for a safety gate includes horizontal frame members which can be expanded sufficiently to place friction pads provided on each end of the horizontal frame members into frictional engagement with the vertical surfaces or walls provided in the doorway or staircase. Such designs for safety gates have several disadvantages. First of all, there is the scenario where the horizontal frame member is not adjusted properly to provide a tight enough fit with the walls. In this case, the gate is not sturdily attached to the walls and, thus, is not very safe as it can be easily pushed over or otherwise defeated by a child or pet. In addition, since such safety gates may sometimes be used at the top of a flight of stairs, an unintended release of the gate from the walls can be disastrous.

Many such designs do not work well in situations where the opposed walls are not exactly parallel, a situation which is not altogether uncommon. In such cases, one of the horizontal frame members may make better frictional contact with the walls than the other horizontal frame member, causing a situation in which the safety gate can also be easily defeated.

Even if the safety gate is properly adjusted to make very tight frictional contact with the opposed walls, the paint or other finish on the opposed walls may be damaged by the friction pads. Lastly, it may be inconvenient to repeatedly have to disconnect and reconnect such compression safety gates when passage through the gate is required by an adult.

Another class of safety gate designs typically includes a more permanent mounting of the gate to one opposed wall and some type of latch to the opposite opposed wall. Typically, the latch may include a mechanism such as a hook and eye combination or other similar mechanism. Such designs also have their inherent drawbacks. First, the locking mechanism may not be adequately secure and may be easily defeated by the child or pet. Second, such gates may not be easily removable from the doorway or staircase when it is not desired to have a gate present at all.

It is against this background, and the desire to solve the problems of the prior art, that the present invention has been developed.

SUMMARY OF THE INVENTION

Accordingly, it is an object of the present invention to provide a new and improved walkthrough gate.

It is another object of this invention to provide a gate which can be quickly, easily, and securely attached to a pair of opposed vertical surfaces as well as be easily removable therefrom.

It is also an object of this invention to provide a gate which when installed, can be pivoted in and out of an operational position.

It is further an object of this invention to provide a gate with a latch mechanism which can be easily operated by an adult but cannot be easily operated by an infant or pet.

It is still further an object of this invention to provide a gate with the above advantages which is also aesthetically pleasing as well as easily manufactured and assembled.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a gate assembly for selectively attaching to two opposed vertical surfaces. The gate assembly includes a gate having two sides, with a width between the two sides slightly less than the width between the two opposed surfaces, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces. The gate assembly also includes an upper retaining sleeve and a lower retaining sleeve mounted to said one of the two opposed surfaces, the retaining sleeves slidably receiving the hinges from above and shaped to support the hinges and prevent the hinges from sliding entirely therethrough. The gate assembly also includes a latch receptacle mounted to the opposite one of the two opposed surfaces for selectively being engaged by the latch on the gate.

The gate may include two separate gate members linked together. The two separate gate members may each have at least one retaining device affixed thereto, the retaining device on each of the gate members slidably receiving the other of the gate members and retaining the two gate members in an adjacent relationship. Each retaining device may include a plastic surface thereon to reduce friction and reduce the force required to cause the gate members to slide relative to each other. The latch receptacle may include a lower lip defined thereon for engagement by the latch and two side walls for retaining the latch therebetween so that the gate cannot be pivoted out of engagement with the latch receptacle. The latch may include a latch body with a notch defined therein for engaging the lower lip defined on the latch receptacle, the latch body being pivotably attached to the gate in a manner which allows the latch body to be pivoted between a lower position suitable for engagement with the latch receptacle and an upper position which is free from engagement with the latch receptacle, the latch further including a spring for biasing the latch body toward the lower position.

The gate may further include at least one linking member, wherein each of the gate members may include a plurality of regularly spaced-apart openings defined therein, the openings being adapted to receive the linking member, so that when the two gate members are placed adjacent one another, the linking member can be selectively employed to link together the two gate members. The latch receptacle may include a recessed portion defined on a side thereof, the recessed portion having side walls to retain the latch therein and substantially prevent pivoting of the gate about the hinges when the latch is engaged. The recessed portion may be defined on a top side thereof. The latch may include a latch body attached to the gate in a manner which allows the latch body to be moved vertically between an upper position that is out of engagement with the latch receptacle and a lower position that is suitable for engagement with the latch receptacle, the latch body being biased toward the lower position. The latch receptacle may include at least one inclined surface adjacent the recessed portion, to move the latch body toward the upper position as the latch is pivoted into engagement with the latch receptacle, the latch body then being free to move, due to its bias, back toward the lower position when the latch body is above the recessed portion.

Alternatively, the recessed portion may be defined on a lateral side thereof. The latch may include a latch body attached to the gate in a manner which allows the latch body to be moved horizontally between an inner position that is out of engagement with the latch receptacle and an outer position that is suitable for engagement with the latch receptacle, the latch body being biased toward the outer position. The latch receptacle may include at least one inclined surface adjacent the recessed portion, to move the latch body toward the inner position as the latch is pivoted into engagement with the latch receptacle, the latch body then being free to move, due to its bias, back toward the outer position when the latch body is proximate to the recessed portion.

At least one of the upper and lower retaining sleeves may include a retaining clip associated therewith, the retaining clip being mounted adjacent an upper end of the at least one retaining sleeve, the retaining clip being movable between a first position which at least partially blocks an upper entrance to the at least one retaining sleeve through which the corresponding hinge is received and a second position in which the hinge is free to be slidably received into and removed from the retaining sleeve. The retaining clip may be a piece of spring steel which is biased toward the second position.

The present invention is also related to a gate assembly for selectively attaching to two opposed vertical surfaces. The gate assembly includes a gate having two sides, with a width between the two sides slightly less than the width between the two opposed surfaces, the gate including an upper horizontal member and a lower horizontal member having ends on either side thereof, the gate including a pair of hinges, one on ends of each of the upper and lower horizontal members on one side thereof for pivotably coupling the gate to one of the two opposed surfaces, the gate further including a latch on the end of the upper horizontal member on an opposite side from the hinge for selectively coupling the gate to an opposite one of the two opposed surfaces The gate assembly also includes an upper retaining sleeve and a lower retaining sleeve mounted to said one of the two opposed surfaces, the retaining sleeves slidably receiving the hinges from above and shaped to support the hinges and prevent the hinges from sliding entirely therethrough. The gate assembly further includes a pair of receptacles mounted to the opposite one of the two opposed surfaces at vertically-spaced-apart positions thereon for selectively receiving the ends of the upper and lower horizontal members, the uppermost of the pair of receptacles being engaged by the latch on the gate.

Each of the pair of receptacles may include two side walls for retaining the ends of the respective one of the upper and lower horizontal members therebetween so that the gate cannot be pivoted out of engagement with the receptacle, the uppermost of the pair of receptacles including a lower lip defined thereon for engagement by the latch.

The present invention is also related to a method for restricting access by children and pets through an opening defined by a pair of opposed vertical surfaces with a slidably extendable and retractable gate having a latch thereon. The method includes the steps of pivotably coupling the gate to a first one of the pair of opposed vertical surfaces, slidably extending the gate into proximity with the second one of the pair of opposed vertical surfaces, actuating the latch on the gate while continuing to slidably extend the gate into engagement with the second wall, which engagement restricts substantial pivotable movement of the gate, and releasing the latch to allow the latch to engage with the wall to restrict further sliding movement of the gate.

The present invention is also directed to a gate assembly for selectively attaching to two opposed vertical surfaces. The gate assembly includes a gate having two sides, with a width between the two sides slightly less than the width between the two opposed surfaces, the gate including a first gate member and a second gate member, the two gate members being slidably coupled together by a plurality of retaining devices, some of which are affixed to the first gate member and slidably receive the second gate member and some of which are affixed to the second gate member and slidably receive the first gate member, each of the gate members having an upper horizontal piece and a lower horizontal piece having ends on either side thereof, the gate including a pair of hinges, one on ends of each of the upper and lower horizontal pieces of the first gate member on one side thereof for pivotably coupling the gate to one of the two opposed surfaces, the gate further including a latch on the end of the upper horizontal piece of the second gate member on an opposite side from the hinge for selectively coupling the gate to an opposite one of the two opposed surfaces. The gate assembly also includes an upper retaining sleeve and a lower retaining sleeve mounted to said one of the two opposed surfaces, the retaining sleeves slidably receiving the hinges from above and shaped to support the hinges and prevent the hinges from sliding entirely therethrough. The gate further includes a pair of receptacles mounted to the opposite one of the two opposed surfaces at vertically-spaced-apart positions thereon for selectively receiving the ends of the upper and lower horizontal pieces of the second gate member, each of the receptacles having opposed side walls thereon for retaining the ends of the respective one of the upper and lower horizontal members of the second gate member therebetween so that the gate cannot be pivoted out of engagement with the receptacle, the uppermost of the pair of receptacles including a lower lip defined thereon for engagement by the latch. The latch may include a latch body with a notch defined therein for engaging the lower lip defined on the uppermost receptacle, the latch body being pivotably attached to the gate in a manner which allows the latch body to be pivoted between a lower position suitable for engagement with the latch receptacle and an upper position which is free from engagement with the latch receptacle, the latch further including a spring for biasing the latch body toward the lower position.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

IN THE DRAWINGS

Figure 1:
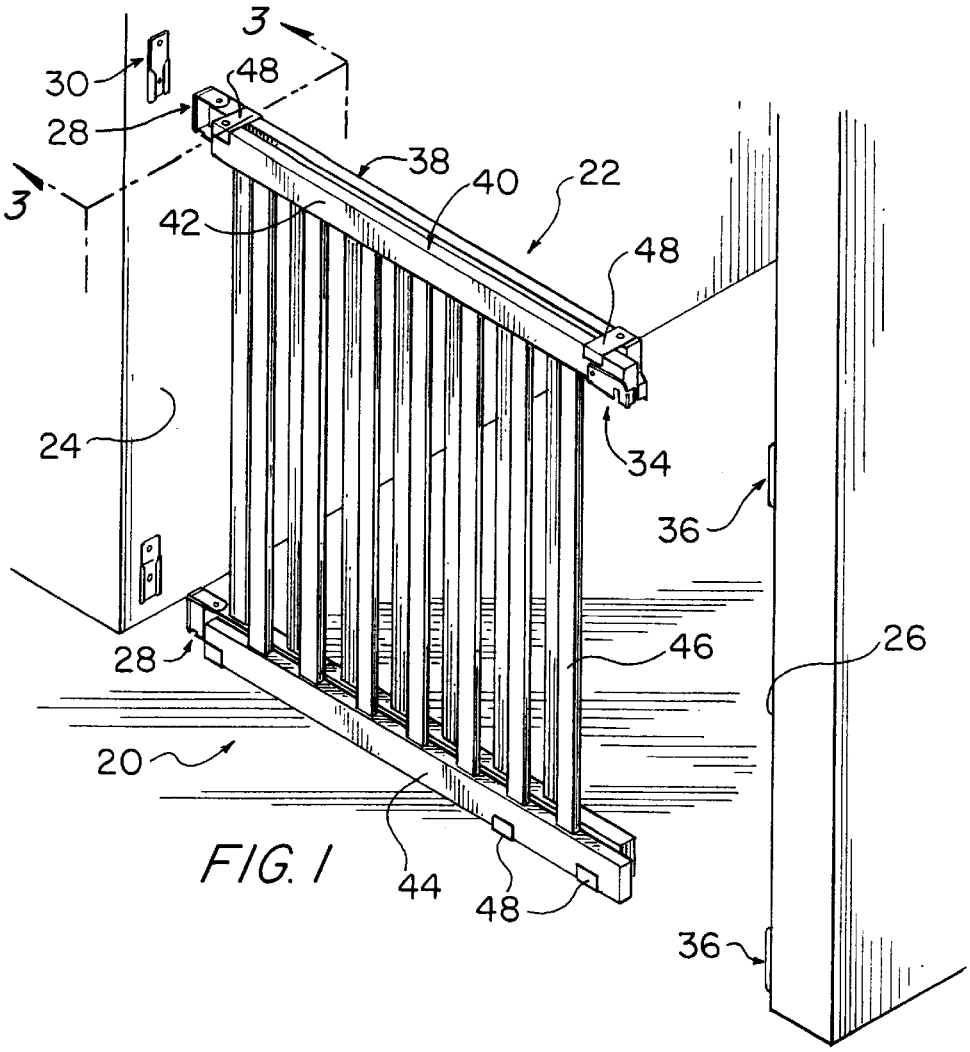
Figure 3:
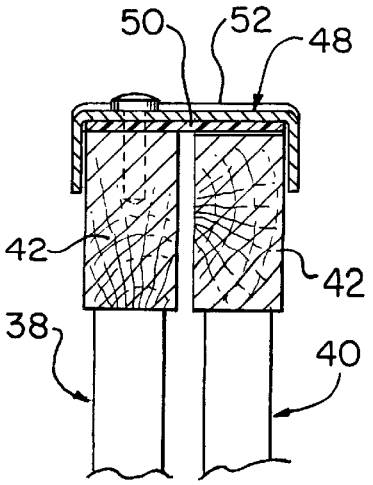
Figure 4:
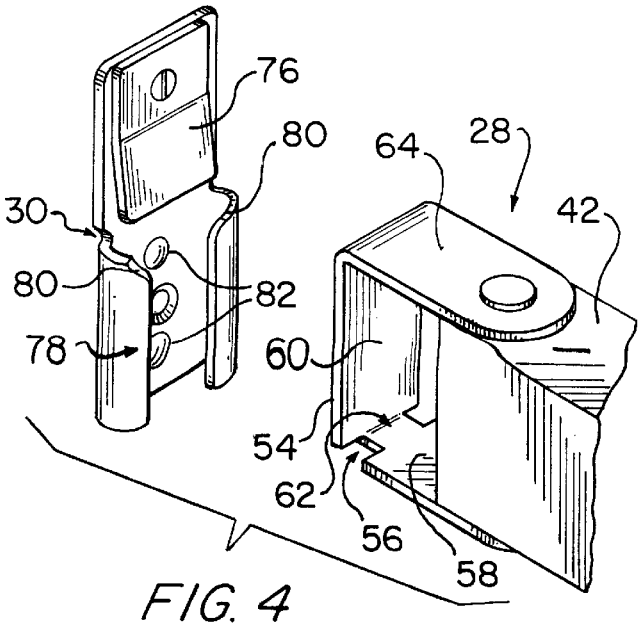
Figure 2:
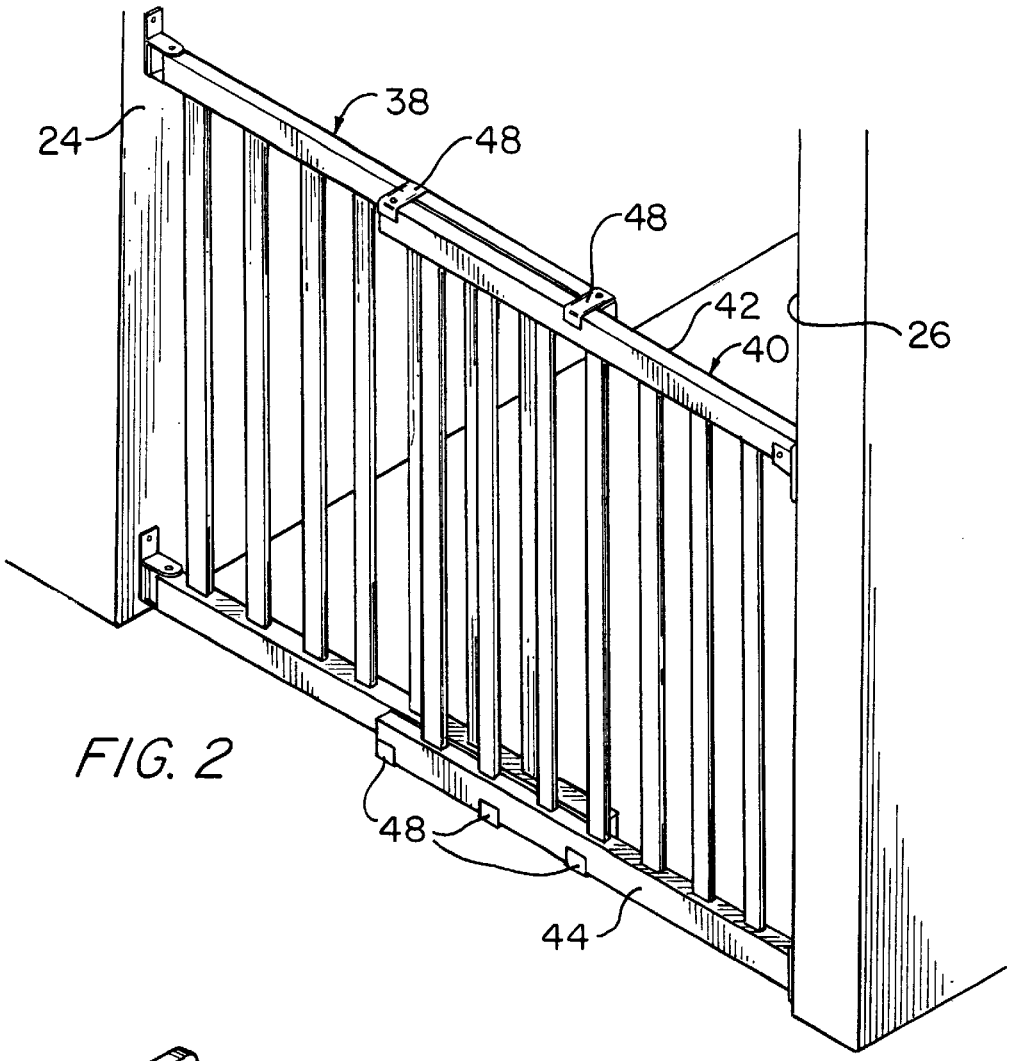
Figure 5:
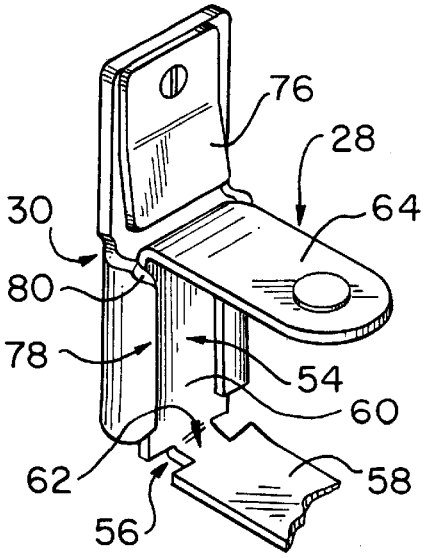
Figure 6:
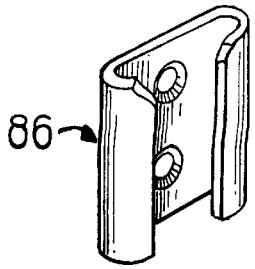
Figure 7:
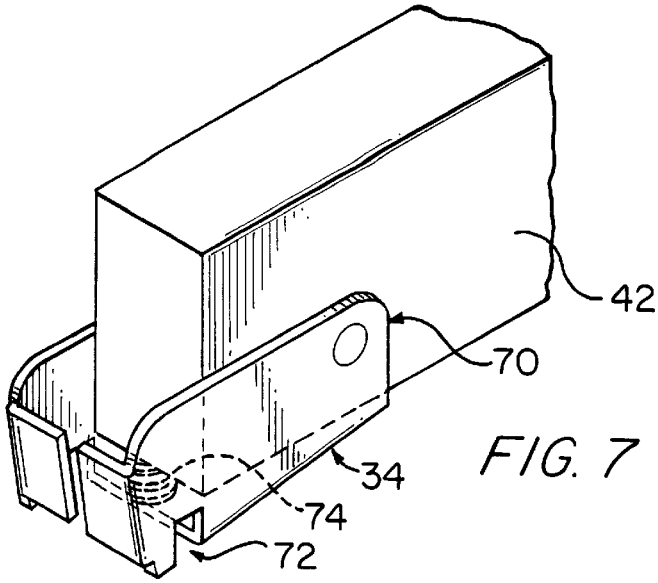
Figure 8:
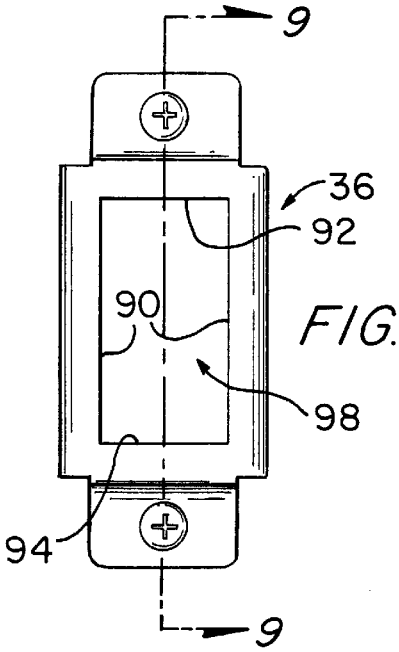
Figure 9:
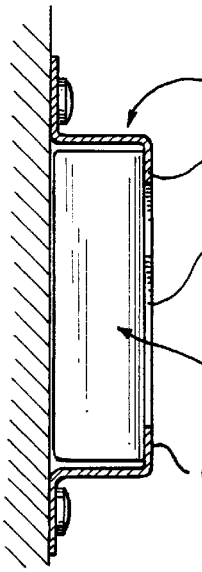
Figure 10:
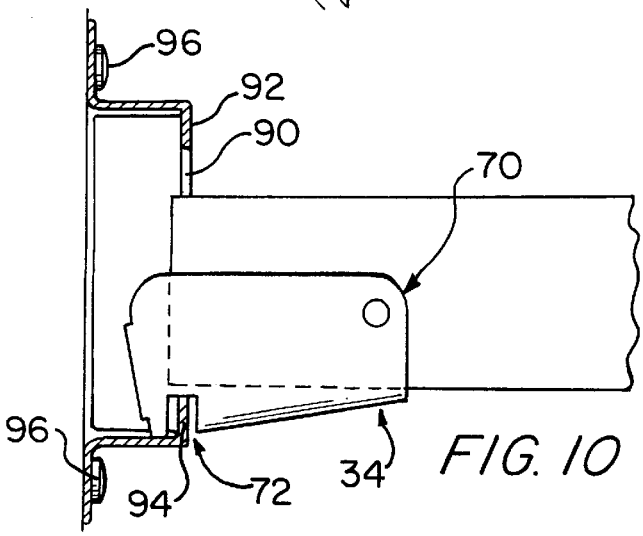
Figure 11:
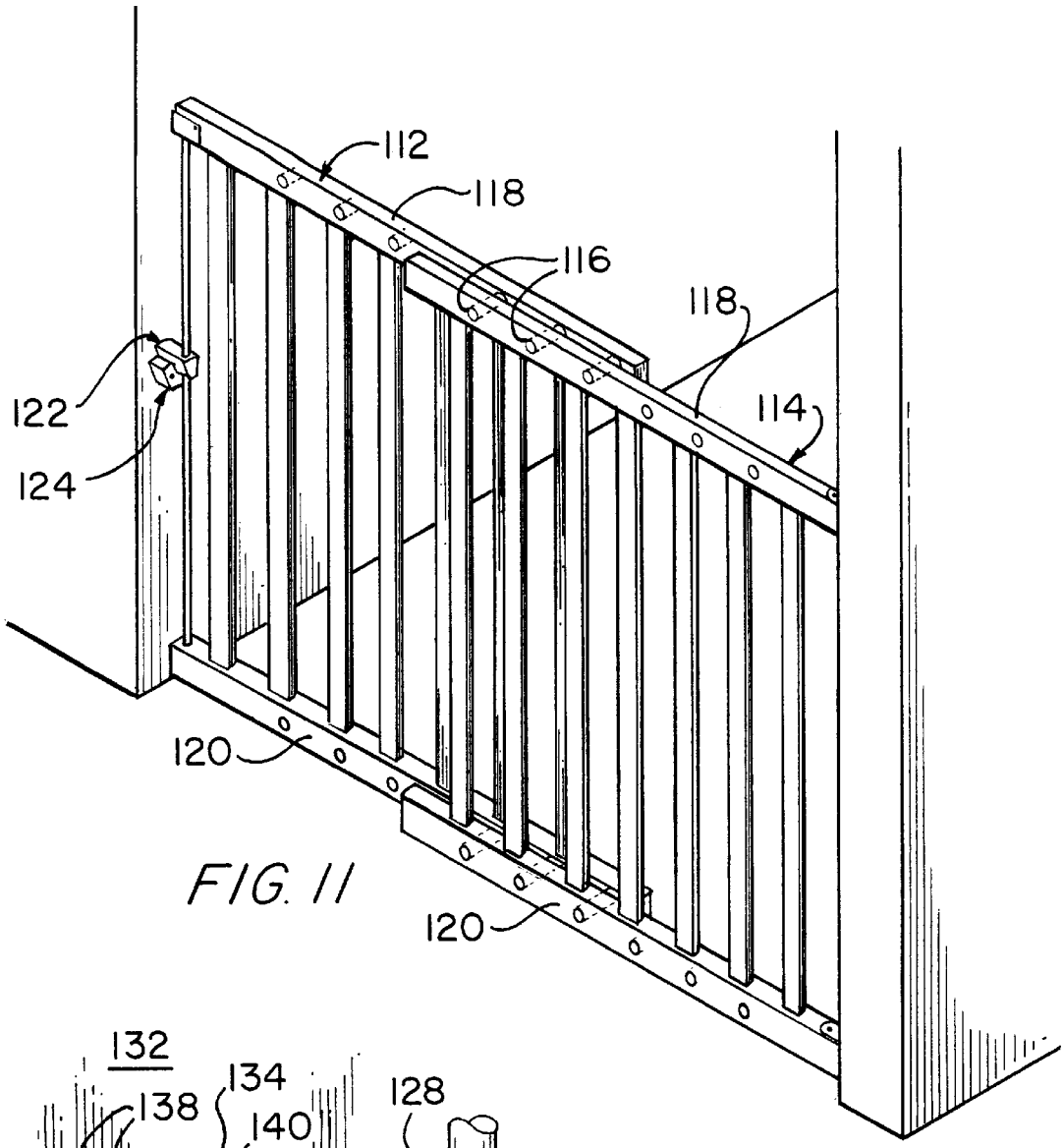
Figure 12:
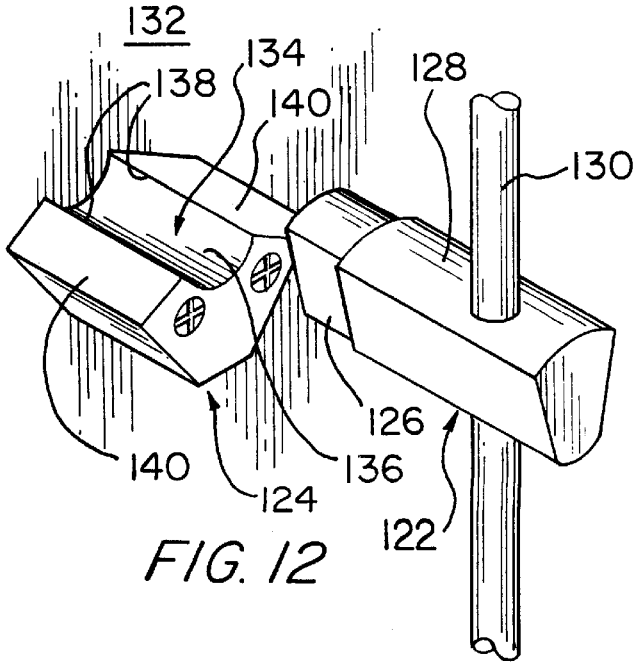
Figure 13:
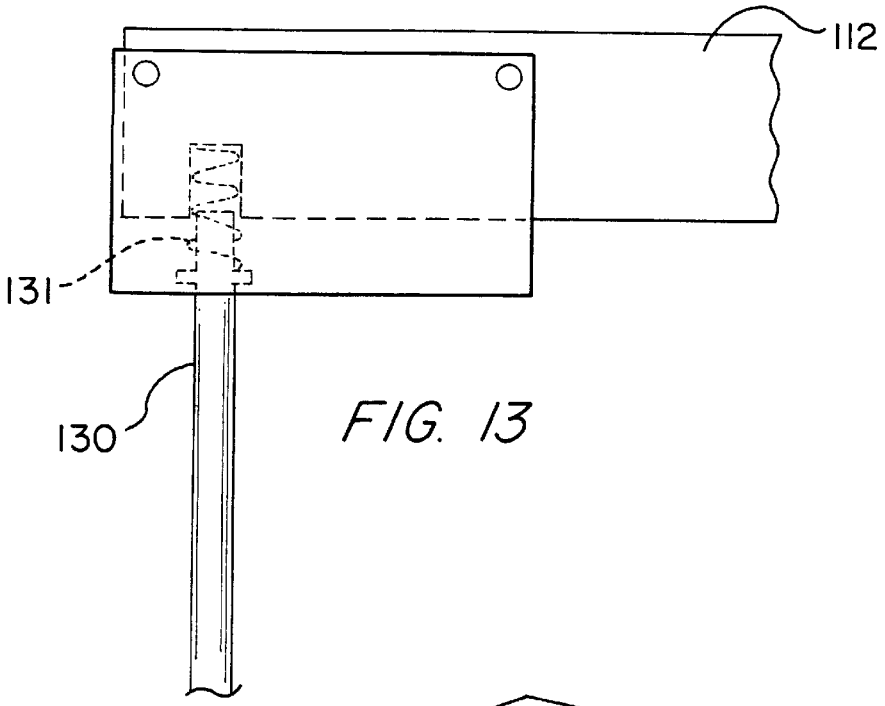
Figure 14:
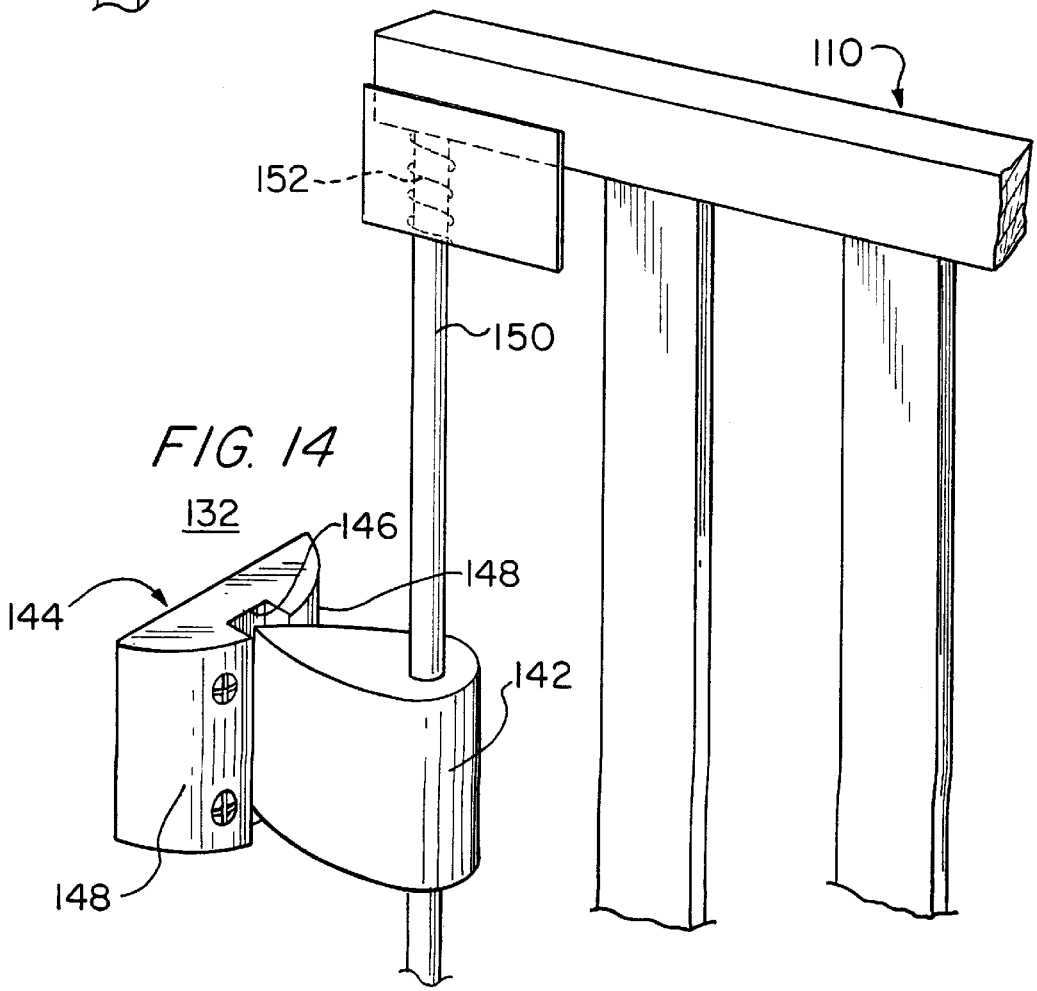

FIG. 1 is a perspective view of a walk-through gate assembly of the present invention showing a sliding gate frame thereof in a retracted position and disconnected from mounting hardware provided on a pair of opposed walls;

FIG. 2 is a perspective view similar to the view of FIG. 1, showing the sliding gate frame in an extended position and mounted in the mounting hardware in the opposed walls;

FIG. 3 is a cross-sectional view taken along line 3—3 of FIG. 1;

FIG. 4 is an enlarged, fragmentary perspective view of the walk-through gate assembly of FIG. 1, showing a hinge on the gate frame and a retaining bracket in close proximity thereto;

FIG. 5 is a view similar to FIG. 4, showing the hinge received within the retaining bracket;

FIG. 6 is an alternative embodiment of a retaining bracket of the present invention;

FIG. 7 is an enlarged, fragmentary perspective view of the walk-though gate assembly of FIG. 1, showing a latch provided on the gate frame;

FIG. 8 is an enlarged front view of a latch receptacle of the walk-through gate assembly shown in FIG. 1;

FIG. 9 is a cross-sectional view taken along line 9—9 of FIG. 8, showing the latch receptacle;

FIG. 10 is a cut-away side view of the latch engaged with the latch receptacle of the walk-through gate assembly of FIG. 1;

FIG. 11 is a perspective view of a second embodiment of a walk-through gate assembly of the present invention;

FIG. 12 is a perspective view of a latch and a latch receptacle of the walk-through gate assembly of FIG. 11;

FIG. 13 is a side view of a spring associated with the latch of FIG. 12; and FIG. 14 is a perspective view of a third embodiment of a latch and a latch receptacle of the walk-through gate assembly of the present invention.

DETAILED DESCRIPTION OF THE PREFERRED EMBODIMENTS

A walk-through gate assembly 20, shown in FIG. 1, includes a sliding gate frame 22 which may be mounted on and attached to various mounting and receptacle hardware provided on a pair of opposed vertical surfaces or walls 24 and 26. The sliding gate frame 22 includes a pair of identical hinges 28 which can be slidably received within upper and lower retaining brackets 30 and 32 mounted on wall 24. The gate frame 22 also includes a latch 34 on an opposite end from the hinges 28 which is selectively engageable with a latch receptacle 36 mounted to wall 26.

The sliding gate frame 22 includes first and second wooden gate members 38 and 40. Each gate member 38 and 40 includes upper and lower horizontal support bases 42 and 44 and a plurality of vertical slats 46 interconnecting the upper and lower bases 42 and 44. Five identical U-shaped brackets 48 are employed on the first and second gate members 38 and 40 to link or retain the gate members in an adjacent position and allow relative longitudinal movement therebetween, so as to retract and extend the sliding gate frame 22. Preferably, the first gate member 38 includes one U-shaped bracket 48 affixed to its upper support base 42 and one bracket 48 affixed to its lower support base 44. The second gate member 40 includes one U-shaped bracket 48 affixed to its upper support base 42 and a pair of brackets 48 affixed to its lower support base 44. As seen best in FIG. 3, each U-shaped bracket 48 is affixed to one of the gate members 38 and 40 and slidably receives the other of the gate members 38 and 40.

To reduce friction between the brackets 48 and the upper and lower support bases 42 and 44 during sliding of the gate members 38 and 40, a plastic insert layer 50 is provided on each bracket 48. Preferably, the plastic insert layer 50 is composed of nylon. Each U-shaped bracket 48 also includes a pair of ridges 52 defined in a top surface thereof, to increase the strength and rigidity of the brackets 48.

The hinges 28 are each pivotably mounted to one of the upper and lower support bases 42 and 44 on one end of the first gate member 38. Each hinge 28 is formed from a flat strip of metal 54 which has been bent at two positions thereon to form a U-shape. A pair of notches 56 are defined in a lower horizontal member 58 of the hinge 28, at a location in the corner 62 where the lower horizontal member 58 transitions into the vertical member 60, as seen in FIG. 4. The notches 56 are sized so as to allow the hinge 28 to be slidably received within one of the retaining brackets 30 and 32. The absence of notches in the upper horizontal member 64 of the hinge 28 prevents the hinge 28 from sliding entirely through one of the retaining brackets 30 and 32.

For engagement with the latch receptacle 36, the latch 34 on the second gate member 40 of the sliding gate frame 22 is mounted on the upper support base 42 thereof at an end closest to the wall 26. The latch 34, best seen in FIGS. 7 and 10, is pivotably mounted to the upper support base 42 at an upper corner 70 of the latch 34. A notch 72 is defined in an opposite lower corner 74 of the latch 34, for engagement with the latch receptacle 36. A spring 74 is retained between the latch 34 and the upper support base 42 as shown in FIG. 7, to bias the latch 34 downward.

Preferably, an end on the lower support base 44 of the second gate member 40 closest to the wall 26 is receivable within a second latch receptacle 36 provided on the wall 26 and at a vertically spaced apart location below the first latch receptacle 36. No latch 34 or similar mechanism is provided on this lower support base 44 of the second gate member 40 for engagement with the second latch receptacle 36.

The upper retaining bracket 30, shown in FIGS. 4 and 5, may or may not include a retaining clip 76 attached thereto, to yieldingly retain the hinge 28 therein. As can be appreciated in FIGS. 1, 2, 4, and 5, the upper retaining bracket 30 is formed from a flat metal piece in the shape of an inverted T. The ends of the cross piece in the T are curled over toward the center, as best seen in FIG. 4 to form a sleeve portion 78 to the retaining bracket 30. At upper ends of the sleeve portion 78 are formed a pair of shoulders 80 which support the upper horizontal member 64 of the hinge 28. A pair of slight protrusions 82 are vertically spaced apart and located within the sleeve portion 78 of the retaining bracket 30. These protrusions 82 serve to more tightly retain the hinge 28 within the bracket 30 so as to reduce rattling of the hinge 28 within the bracket 30. The retaining bracket 30 includes a pair of countersunk openings defined therein to receive screws for mounting the bracket 30 to the wall 24. Optionally, one of the screws can also attach the retaining clip 76 to the retaining bracket 30.

As can be appreciated, the retaining clip 76 is a strip of spring steel which is bent or formed into a non-flat position so as to yieldingly resist the passage of the hinge 28 into the retaining bracket 30. With a small force easily produced by the operator, the retaining clip 76 is flattened and the hinge 28 can pass into the retaining bracket 30. Once the retaining clip 76 springs back into its relaxed, bent position, as shown in FIG. 5, the hinge 28 cannot be easily removed from the retaining bracket 30. In order to remove the hinge 28 from the retaining bracket 30, the retaining clip 76 must be pressed inward (typically by the operator's finger) to allow the hinge 28 to be slipped out of the retaining bracket 30.

Either or both of the retaining brackets 30 and 32 may be provided with a retaining clip 76. Alternatively, neither of the retaining brackets may be provided with a retaining clip 76. In addition, an alternative embodiment of a retaining bracket 86, such as is shown in FIG. 6, may be substituted for either or both of the upper and lower retaining bracket 30 and 32. In the case of this second embodiment of the retaining bracket 86, there is no provision for attaching a retaining clip 76 as there is no material on the retaining bracket 86 above the shoulders thereon.

One of the latch receptacles 36 provided on the wall 26 is best seen in FIGS. 8 and 9. As can be appreciated, the latch receptacle 36 includes a pair of side walls 90 and upper and lower lips 92 and 94. The receptacle 36 is attached to the wall 26 by a pair of screws 96. As can be best seen in FIG. 10, the latch 34 and the end of the upper support base 42 may be slidably inserted into the latch receptacle 36 in the opening 98 defined between the side walls 90 and the upper and lower lips 92 and 94. In order to insert the latch 34 and the end of the upper support base 42 into the opening 98, the latch 34 must be actuated, against the force of the spring 74, to reduce the cross-sectional height of the latch 34 and upper support base 42 combination. Once this combination has been inserted a sufficient distance into the opening 98, the latch 34 can be released and the spring 74 will force the latch 34 downward until the latch 34 engages via its notch 72 with the lower lip 94 of the receptacle 36.

When in this position, it can be appreciated that the second gate member 40 cannot be slid back toward the opposite wall 24 due to the engagement of the latch 34 with the lower lip 94 of the receptacle 36. Further, the sliding gate frame 22 cannot be pivoted significantly about the hinges 28 since the latch 34 and end of the upper support base 42 are retained between the pair of side walls 90 of the receptacle 36. To provide additional rigidity and sturdiness to the gate assembly 20 when coupled to the wall 26, an end of the lower support base 44 of the second gate member 40 which is closest to the wall 26 is slidably received within the second latch receptacle 36 corresponding thereto and attached to the wall 26. This arrangement serves to retain the lower support base 44 of the second gate member 40 within the latch receptacle 36 and further prevent pivotable movement about the hinges 28, as well as to prevent the sliding gate frame 22 from being pivoted downward relative to the wall 24.

As has been described, the assorted hardware including the retaining brackets 30 and 32 and the latch receptacles 36 can be attached to walls 24 and 26. When it is desired to install the sliding gate frame 22, the hinges 28 on the first gate member 38 can be slidably inserted into the retaining brackets 30 and 32. When pivotably installed in this fashion, the sliding gate frame 22 can be placed in a retracted position by sliding the second gate member 40 toward the opposite wall 24. In this position, as shown in FIG. 1, the sliding gate frame 22 presents a smaller footprint than when extended and can be more easily pivoted out of the way such as to a position parallel to wall 24. When it is desired to restrict access with the gate assembly 22, the sliding gate frame 22 can be pivoted back to a perpendicular position relative to the walls 24 and 26, the sliding gate frame 22 can be placed in an extended position by sliding the second gate member 40 relative to the first gate member 38 toward the wall 26, and the latch 34 can be actuated as it and the upper and lower support bases 42 and 44 of the second gate member 40 are slidably inserted into the latch receptacles 36. When the sliding gate frame 22 is latched or coupled in this manner to the walls 24 and 26, the width of the sliding gate frame 22 will be just slightly less than the width between the walls 24 and 26. Of course, in a similar fashion, when it is desired to disengage the sliding gate frame 22 from the wall 26, the latch 34 can again be actuated while the second gate member 40 is slid toward the opposite wall 24.

In an alternative embodiment of a sliding gate frame 110 shown in FIGS. 11 and 12, first and second gate members 112 and 114 are attached together by a plurality of fixed links 116. The links 116 are received through holes drilled in upper and lower support bases 118 and 120 of both the first and second gate members 112 and 114. With the links 116 installed, significant relative longitudinal movement is not possible between the gate members 112 and 114. The sliding gate frame 110 is relatively more difficult to retract and extend than the sliding gate frame 22 due to the semi-fixed nature of the connection between the gate members 112 and 114. For this reason, a different latch 122 and latch receptacle 124 are provided for this embodiment. The latch 122 includes a two-part latch body in which an inner part 126 is slidably received within an outer sleeve 128 to vary the extendable length of the latch 122. The latch 122 is mounted on a vertical rod 130 which is slidably attached between support bases 118 and 120 to the gate member 112 and biased downward by a spring 131 (FIG. 13). The latch receptacle 124 includes a block mounted on a wall 132 by a pair of screws. The latch receptacle 124 is shaped to define a recessed portion 134 on a top side thereof. The recessed portion 134 is shaped to provide a lower central region 136 and a pair of raised side walls 138 on either side thereof. Also on the top side of the latch receptacle 124 on each of the lateral sides of the recessed portion 134 are a pair of sloped cam surfaces 140. The gate frame 110 can be pivoted toward the latch receptacle 124 so that the latch 122 makes contact with the latch receptacle 124. Depending upon the width of the gate frame 110 relative to the opening defined between the walls, the inner part 126 of the latch 122 may or may not be necessary to reach the receptacle 124. Either way, the latch 122 will preferably first contact the receptacle 124 at one of the pair of cam surfaces 140. As the gate frame 110 is pivoted further, the cam surface 140 will urge the latch 122 and rod 130 upward against the bias of the spring 131. Once the latch 122 is above the recessed portion 134 of the receptacle 124, the latch 122 and rod 130 can move downward and settle against the central region 136. As can be appreciated, further pivotable movement is substantially prevented by the side walls 138. To disengage the latch 122 from the receptacle 124, the latch 122 and rod 130 must be forced upward against the bias of the spring 131 while the gate frame 110 is pivoted away from the receptacle 124.

An alternative embodiment of a latch and latch receptacle for the gate frame 110 may include a latch 142, as shown in FIG. 14, which is moveable inward and outward (away from and toward the wall 132) and a latch receptacle 144 with a recessed portion 146 and cam surfaces 148 defined on lateral sides thereof (e.g., on the sides toward the gate frame 110) rather than on the top side as was the case with the receptacle 124. The latch 142 is attached to a vertical rod 150 and is biased outward toward the latch receptacle 144 and wall 132 by a spring 152.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The invention claimed is:

1. A gate assembly for use with two opposed surfaces and for selective attachment thereto, the gate assembly comprising:

a gate having two sides, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces, the latch having a nose defined on an end thereof, the gate including two separate gate members linked together, wherein the two gate members are horizontally slidable relative to each other to vary an effective width of the gate;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a latch receptacle adapted for mounting to the opposite one of the two opposed surfaces for selectively being engaged by the latch on the gate, the latch receptacle defining a peripheral boundary having four walls defining an opening into which the nose of the latch projects and is received;

wherein the nose of the latch is slidably received within the opening of the latch receptacle, to project there into, by sliding the two gate members relative to each other to increase the effective width of the gate.

2. A gate assembly as defined in claim 1, wherein the two separate gate members each have at least one retaining device affixed thereto, the retaining device on each of the gate members slidably receiving the other of the gate members and retaining the two gate members in an adjacent relationship.

3. A gate assembly as defined in claim 2, wherein a force is required to cause the gate members to slide relative to each other, and wherein each retaining device includes a plastic surface thereon to reduce friction and reduce the force required to cause the gate members to slide relative to each other.

4. A gate assembly as defined in claim 1, wherein the latch receptacle includes a lower lip defined thereon for engagement by the latch and two side walls for retaining the latch therebetween so that the gate cannot be pivoted out of engagement with the latch receptacle.

5. A gate assembly for use with two opposed surfaces and for selective attachment thereto, the gate assembly comprising:

a gate having two sides, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a latch receptacle adapted for mounting to the opposite one of the two opposed surfaces for selectively being engaged by the latch on the gate, wherein the latch receptacle includes a lower lip defined thereon for engagement by the latch and two side walls for retaining the latch therebetween so that the gate cannot be pivoted out of engagement with the latch receptacle;

wherein the latch includes a latch body with a notch defined therein for engaging the lower lip defined on the latch receptacle, the latch body being pivotably attached to the gate in a manner which allows the latch body to be pivoted between a lower position suitable for engagement with the latch receptacle and an upper position which is free from engagement with the latch receptacle, the latch further including a spring for biasing the latch body toward the lower position.

6. A gate assembly for use with two opposed surfaces and for selective attachment thereto, the gate assembly comprising:

a gate having two sides, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a latch receptacle adapted for mounting to the opposite one of the two opposed surfaces for selectively being engaged by the latch on the gate;

wherein the latch includes a latch body pivotably attached to the gate in a manner which allows the latch body to be pivoted between a lower position suitable for engagement with the latch receptacle and an upper position which is free from engagement with the latch receptacle.

7. A gate assembly as defined in claim 6, wherein the latch further includes a spring for biasing the latch body toward the lower position.

8. A gate assembly as defined in claim 7, wherein the latch body includes a notch defined therein for engaging the latch receptacle.

9. A gate assembly for use with two opposed surfaces and for selective attachment thereto, the gate assembly comprising:

a gate having two sides, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a latch receptacle adapted for mounting to the opposite one of the two opposed surfaces for selectively being engaged by the latch on the gate;

wherein the latch includes a latch body attached to the gate in a manner which allows the latch body to be moved vertically between an upper position that is out of engagement with the latch receptacle and a lower position that is suitable for engagement with the latch receptacle, the latch body being biased toward the lower position.

10. A gate assembly as defined in claim 9, the gate further including two separate gate members linked together, wherein the two separate gate members each have at least one retaining device affixed thereto, the retaining device on each of the gate members slidably receiving the other of the gate members and retaining the two gate members in an adjacent relationship, the gate also including at least one linking member, wherein each of the gate members includes a plurality of regularly spaced-apart openings defined therein, the openings being adapted to receive the linking member, so that when the two gate members are placed adjacent one another, the linking member can be selectively employed to link together the two gate members.

11. A gate assembly as defined in claim 9, wherein the latch receptacle includes a recessed portion defined on a side thereof, the recessed portion having side walls to retain the latch therein and substantially prevent pivoting of the gate about the hinges when the latch is engaged.

12. A gate assembly as defined in claim 11, wherein the recessed portion is defined on a top side thereof.

13. A gate assembly as defined in claim 11, wherein the latch receptacle includes at least one inclined surface adjacent the recessed portion, to move the latch body toward the upper position as the latch is pivoted into engagement with the latch receptacle, the latch body then being free to move, due to its bias, back toward the lower position when the latch body is above the recessed portion.

14. A gate assembly as defined in claim 11, wherein the recessed portion is defined on a lateral side thereof.

15. A gate assembly as defined in claim 14, wherein the latch includes a latch body attached to the gate in a manner which allows the latch body to be moved horizontally between an inner position that is out of engagement with the latch receptacle and an outer position that is suitable for engagement with the latch receptacle, the latch body being biased toward the outer position.

16. A gate assembly as defined in claim 15, wherein the latch receptacle includes at least one inclined surface adjacent the recessed portion, to move the latch body toward the inner position as the latch is pivoted into engagement with the latch receptacle, the latch body then being free to move, due to its bias, back toward the outer position when the latch body is proximate to the recessed portion.

17. A gate assembly for use with two opposed surfaces and for selective attachment thereto, the gate assembly comprising:

a gate having two sides, the gate including an upper hinge and a lower hinge on one side thereof for pivotably coupling the gate to one of the two opposed surfaces, the gate further including a latch on the opposite side thereof for selectively coupling the gate to an opposite one of the two opposed surfaces;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough, wherein at least one of the upper and lower retaining sleeves includes a retaining clip associated therewith, the retaining clip being mounted adjacent an upper end of the at least one retaining sleeve, the retaining clip being movable between a first position which at least partially blocks an upper entrance to the at least one retaining sleeve through which the corresponding hinge is received and a second position in which the hinge is free to be slidably received into and removed from the retaining sleeve; and a latch receptacle adapted for mounting to the opposite one of the two opposed surfaces for selectively being engaged by the latch on the gate.

18. A gate assembly as defined in claim 17, wherein the retaining clip is a piece of spring steel which is biased toward the second position.

19. A gate assembly for use with two opposed surfaces and for selective attachment thereto, the gate assembly comprising:

a gate having two sides, the gate including an upper horizontal member and a lower horizontal member having ends on either side thereof, the gate including a pair of hinges, one on ends of each of the upper and lower horizontal members on one side thereof for pivotably coupling the gate to one of the two opposed surfaces, the gate further including a latch on the end of the upper horizontal member on an opposite side from the hinge for selectively coupling the gate to an opposite one of the two opposed surfaces, the gate also including two separate gate members linked together, wherein the two gate members are horizontally slidable relative to each other to vary an effective width of the gate;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a pair of receptacles adapted for mounting to the opposite one of the two opposed surfaces at vertically-spaced-apart positions thereon for selectively receiving the ends of the upper and lower horizontal members, an uppermost of the pair of receptacles being engaged by the latch on the gate, the uppermost of the pair of latch receptacles defining a peripheral boundary into which the latch is received and a lowermost of the pair of latch receptacles defining a peripheral boundary into which the end of the lower horizontal member is received;

wherein the latch is slidably received within the uppermost of the pair of latch receptacles by sliding the two gate members relative to each other to increase the effective width of the gate.

20. A gate assembly as defined in claim 19, wherein each of the pair of receptacles includes two side walls for retaining the ends of the respective one of the upper and lower horizontal members therebetween so that the gate cannot be pivoted out of engagement with the receptacle, the uppermost of the pair of receptacles including a lower lip defined thereon for engagement by the latch.

21. A gate assembly for use with two opposed surfaces and for selective attachment thereto, the gate assembly comprising:

a gate having two sides, the gate including a first gate member and a second gate member, the two gate members being slidably coupled together by a plurality of retaining devices, some of which are affixed to the first gate member and slidably receive the second gate member and some of which are affixed to the second gate member and slidably receive the first gate member, each of the gate members having an upper horizontal piece and a lower horizontal piece having ends on either side thereof, the gate including a pair of hinges, one on ends of each of the upper and lower horizontal pieces of the first gate member on one side thereof for pivotably coupling the gate to one of the two opposed surfaces, the gate further including a latch on the end of the upper horizontal piece of the second gate member on an opposite side from the hinge for selectively coupling the gate to an opposite one of the two opposed surfaces;

an upper retaining sleeve and a lower retaining sleeve adapted for mounting to said one of the two opposed surfaces, the retaining sleeves slidably receiving the hinges from above and shaped to support the hinges and prevent the hinges from sliding entirely therethrough; and a pair of receptacles adapted for mounting to the opposite one of the two opposed surfaces at vertically-spaced-apart positions thereon for selectively receiving the ends of the upper and lower horizontal pieces of the second gate member, each of the receptacles having opposed side walls thereon for retaining the ends of the respective one of the upper and lower horizontal members of the second gate member therebetween so that the gate cannot be pivoted out of engagement with the receptacle, the uppermost of the pair of receptacles including a lower lip defined thereon for engagement by the latch;

wherein the latch includes a latch body with a notch defined therein for enraging the lower lip defined on the uppermost receptacle, the latch body being pivotably attached to the gate in a manner which allows the latch body to be pivoted between a lower position suitable for engagement with the latch receptacle and an upper position which is free from engagement with the latch receptacle, the latch further including a spring for biasing the latch body toward the lower position.

22. A gate assembly for use with two opposed surfaces and for selective attachment thereto, the gate assembly comprising:

a gate having two sides, the gate having engagement surfaces defined proximate to one side thereof for pivotably coupling the gate to one of the two opposed surfaces, the gate further including a latch on the opposite side thereof for selectively coupling the gate to an opposite one of the two opposed surfaces, the latch having a lip-engaging surface including a notch defined thereon, the latch being vertically-actuable to raise and lower the lip-engaging surface having the notch;

an upper retaining member and a lower retaining member adapted for mounting to said one of the two opposed surfaces, the retaining members having portions defined thereon for engaging with the engagement surfaces on the gate, to support the gate thereon and allow the gate to pivot relative to the retaining members; and a latch receptacle adapted for mounting to the opposite one of the two opposed surfaces, the latch receptacle defining an upwardly-protruding lip for selective engagement by the lip-engaging surface on the latch;

wherein the gate is manipulated to place the latch proximate to the latch receptacle and the latch is selectively actuated by vertical actuation of the latch to engage and disengage the lip-engaging surface of the latch with the lip on the latch receptacle.

23. A gate assembly as defined in claim 22, wherein the lip-engaging surface includes a downwardly-protruding member forming a notch and wherein the lip is located on a lower portion of the latch receptacle to engage with the notch.

24. A gate assembly as defined in claim 22, further including a second receptacle adapted for mounting to the opposite one of the two opposed surfaces, the first latch receptacle being adapted for mounting to the opposite one of the two opposed surfaces at a position above the second receptacle.

* * * * *